US005970999A

United States Patent [19]

Greenia

[11] Patent Number: 5,970,999

[45] Date of Patent: Oct. 26, 1999

[54] HYDRAULIC VACUUM PUMP

[75] Inventor: Maurice J. Greenia, 1430 Bishop Rd., Grosse Pointe, Mich. 48230-1148

[73] Assignee: Maurice J. Greenia, Grosse Pointe, Mich.

[21] Appl. No.: 09/197,891

[22] Filed: Nov. 23, 1998

[51] Int. Cl.[6] ..... F04F 10/00

[52] U.S. Cl. ..... 137/1; 119/250; 137/128; 137/147; 417/65

[58] Field of Search ..... 119/249, 250; 137/1, 128, 147; 417/65

[56] References Cited

U.S. PATENT DOCUMENTS 4,951,699 8/1990 Lipman ..... 137/147 X

*Primary Examiner*—Gerald A. Michalsky
*Attorney, Agent, or Firm*—Dinnin & Dunn, P.C.

[57] ABSTRACT

The hydraulic vacuum pump (HVP) uses a centrifugal water pump with unconventional inlet and outlet connections that cause unconventional patterns of fluid flow. Valves are not required for operation. The submerged pump outlet must be kept open and unobstructed to flow, and must also be no smaller in cross-sectional area than the submerged pump-inlets. The pump inlet branches into two openings, each for a distinctly different purpose. A submerged pump-priming inlet branch uses an orifice of predetermined size to assure minimum liquid flow while also controlling both rate and limit of air extraction. The other inlet opening is connected to a fixed priming-siphon from which air is extracted as it is mixed with liquid in the pump in a novel automatic, pressure-activated cyclic action, and freely expelled in the outflow. The crown of the priming-siphon is equipped with an air inlet that may be connected by leakproof channels to the crowns of one or more other siphons that have the same or lesser elevations for priming, or to other enclosed spaces from which air that may be mixed with liquid is to be extracted at subatmospheric pressure.

20 Claims, 2 Drawing Sheets

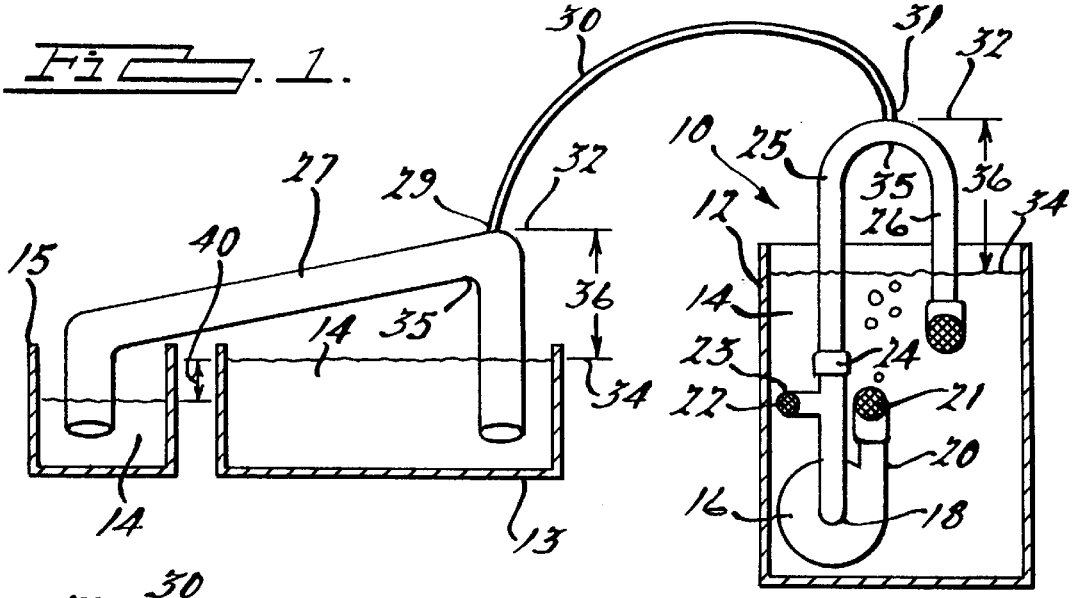
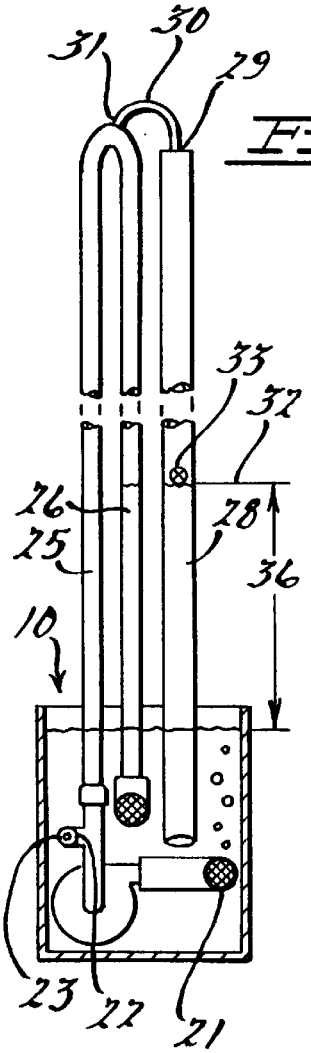
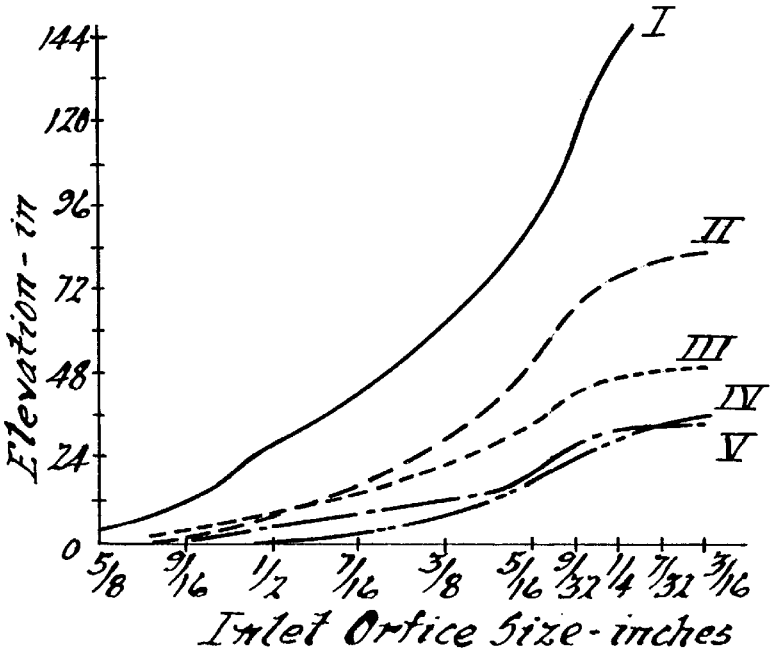
FIG. 3.

HYDRAULIC VACUUM PUMP

BACKGROUND OF THE INVENTION

1. Field of the Invention

The present invention relates generally to vacuum pumps and siphons, and more specifically to a hydraulic vacuum pump that uses a centrifugal pump in a new way to evacuate gases along with liquids, for priming siphons and for other uses where gases must be removed while mixed with liquids at subatmospheric pressure.

2. Description of Related Art

A siphon is a leakproof solid channel, shaped and positioned to carry liquid from a source up and over an elevated point and down to an outlet at a lower level. A siphon must have at least its upper (source) end submerged to allow atmospheric pressure to hold it full of liquid after it has been primed (filled), so that flow is powered by gravity. A siphon's elevation is the vertical rise from the liquid-surface of the source to the crown (highest part) of the siphon. Pressure within the elevated parts (every part between the source-surface and the crown) of a working siphon is always subatmospheric. The maximum elevation of liquid in a siphon depends on the specific gravity (sg) of the liquid and atmospheric pressure. Water at 1.0 sg can be elevated in a siphon to no higher than about 34 feet at sea level.

It should be noted that a fully operating siphon is very energy efficient. It moves liquid at the rate of flow the aforementioned factors permit, using only gravity for motive power and atmospheric pressure to hold liquid. But reliability of siphons needs improvement. Accidental starting or stopping of a siphon is often inconvenient, or costly, or dangerous.

Siphons are used in systems for flood control in rivers and reservoirs, chemical processes, desalination, power generation, motor vehicles, manufacturing, medicine, brewing, farming, livestock care, hatcheries, zoos, aquariums and many other uses.

Siphons can be built from many different man-made materials including reinforced concrete, pipes and fittings of metal or plastic, flexible tubing, and others. Modem materials make far better siphons than were available to ancient builders.

Atmospheric pressure of 14.7 pounds per square inch at sea level, is the weight of air pressing down on the earth's surface, and is the force that holds liquid in a siphon. Subatmospheric pressure, also called a vacuum, is in the elevated parts of working siphons.

Subatmospheric pressure in the elevated parts of a liquid-filled siphon, allows any leak to admit air. The lower pressure also causes gases that are dissolved in the liquid to effervesce. Thus, whenever enough air or other gases gradually enter the highest part or crown of a siphon to drop the liquid level below the crown, flow through the siphon is reduced. When the level drops below the bend or crest of the siphon, the flow stops entirely. And whenever air can enter freely, from an unsubmerged end or an unusually large break or leak in an elevated part, the siphon empties all liquid as fast as it can flow out. Freely admitting air to stop siphon flow can be done by installing a "vacuum breaker" valve at the crown. Blocking the siphon channel with a shutoff valve or end-cap will also stop flow, as will frozen liquid or clogged foreign matter. Most commonly the liquid moved through a siphon is unfrozen water, but many other free-flowing liquids can be siphoned. Most commonly the gas to be removed from a siphon is air, but any other gas that behaves like air could be there.

Before a siphon can efficiently start to carry water or any other liquid, all of the air or any other gas inside the siphon must be replaced by liquid. This process is called priming, filling or starting the siphon.

There are several well-known ways to start a siphon:

Inversion siphon-priming, well known to brewers, aquarium keepers and others, may be the most ancient method of siphon-starting still commonly used. A small siphon is inverted, filled by either immersion or pouring, and outflow is blocked until it is placed into a working siphon position.

The same human lung-power that makes a soda-straw work, is another ancient method often used to start small siphons.

Self-priming siphons have a low elevation so that siphoning begins when a rise in water level causes liquid to enter from the upper end, enough to cause continuous flow. The most common man-made self-priming siphons are rather large, typically made of reinforced concrete, with diameter, elevation and length measured in meters, most often used for controlling water levels in reservoirs. Other examples of self-priming siphons on a comparatively miniature scale, include U.S. Pat. Nos. 5,738,137; 4,846,206; and 4,124,035. The latter one is so small that capillary action affects its performance.

Induced-flow can start siphons that have a size or shape that restricts air-inlet from the lower end. Liquid is caused to flow through from the source end of the siphon, by any one of several different methods, until unassisted gravity-power can sustain continuous flow. The oldest known method of this kind was invented in the first century AD by Hero of Alexandria. The Internet in May, 1998, displayed two similar methods. One, under Siphons, was *Starting a Python Siphon* (for aquariums) by George Booth; and the other, under Siphons & Tubing, *Phil's Psyphon Starter* by brewguys.

Pumping or pouring full to the brim of an opened siphon-crown, will effectively prime a siphon in working position, provided that its lower ends are blocked shut. The crown-opening is then closed airtight before unblocking the lower ends; then flow can begin. This method of siphon-filling was introduced for an aquarium fish-bridge in U.S. Pat. No. 5,067,439.

Vacuum siphon-priming can fill any size siphon that is in working condition, either before startup or during operation, without moving the siphon itself. Air is extracted from the crown of the siphon, which allows atmospheric pressure to force liquid up into the evacuated space.

Other siphon-starters can only be used before the siphon begins to operate. Air in a working siphon inevitably rises to the top. If siphon-starting is limited to one of those methods and air in the siphon stops its flow, the startup process must usually be repeated after correcting, if possible, whatever problem allowed the air to get in.

The simplest form of vacuum-pump air-extraction for small siphons is a hand-operated bellows or squeeze-bulb equipped with one-way valves. Examples of this method of siphon-priming can be seen in U.S. Pat. Nos. 5,230,298; 3,670,758; and 192,595.

Many kinds of power-driven vacuum machines are well known. They include household vacuum cleaners, the inlet of an air pump or air compressor, industrial vacuum pumps that rapidly exhaust high volumes of air, sophisticated scientific machines that attain a near-perfect vacuum, and others. All of these are made for handling air or other gases alone, not mixed with liquids. Most air pumps and vacuum pumps would be damaged if liquid entered the pump itself. A method of either separating liquids from gases ahead of the pump inlet, or stopping the pump before liquid can enter, is commonly found where such machines may encounter liquids. With protection from liquid entry, vacuum machines designed to quickly move high volumes of air can be a very efficient way to exhaust air from a siphon, within limits of how much low pressure it can produce.

An example of vacuum-priming in a large-scale siphon, as described in a reference volume, was operated in a desalination plant on the island of Malta in 1975. A siphon 200 meters long, 4 meters in elevation and 0.8 meters diameter carried sea water to the plant. It was primed by a vacuum pump in about two hours. The vacuum pump was then operated continuously to extract entrained air.

Also well-known, but not found applicable to siphon-priming, is the subatmospheric pressure (vacuum) available at the inlet of any liquid-handling pump, whether centrifugal or positive-displacement. Measurement of the low pressure of such pump-inlets is often expressed in terms of "suction lift", which is the vertical distance that atmospheric pressure will force water upward to the pump inlet, minus losses due to flow-friction in the line. A mechanic's reference book typically states a limit of "practical suction lift" on positive-acting pumps as about 22 feet, and on centrifugal pumps about 15 feet. However, in order to obtain even that much "lift", a liquid handling pump must he "pre-primed"; that is, it must already be liquid-filled, or have liquid flowing through.

A dry centrifugal pump has no suction lift at all, and a dry positive-displacement pump would need very unusual seals against air leaks before it could produce enough suction lift to prime a siphon of very low elevation. Furthermore, positive displacement pumps often have difficulties attempting to handle air/water (gas/liquid) mixtures.

The venturi effect, based on Bernoulli's theorem which explains how pressure drops as speed increases in fluid flow, is another prior art way to vacuum-prime a siphon. Typically, the outflow of a liquid pump is passed through a venturi device to produce vacuum. Efficiency is low, but venturi-produced vacuum can prime a low-elevation siphon. Examples of venturi siphon-priming can be found in U.S. Pat. Nos. 4,036,756; 4,579,139; and 4,951,699.

The first fish-bridge siphon that interconnected two aquariums appeared in U.S. Pat. No. 192,595. Subsequently, fish bridge siphon variations are found in U.S. Pat. Nos. 1,576,462; 3,903,844; 5,067,439; and 5,230,298. More fish-display siphons for aquariums with very complex designs can be found in U.S. Pat. Nos. 5,282,438 and 5,605,115.

The inventor's U.S. Pat. No. 3,903,844 included circulation of aerated and filtered water in a double-tank fish-bridge siphon. A smaller siphon was built into the back edge of the fish-bridge. A small opening at the crown of the smaller siphon interconnected the two siphons. Water flowed slowly through the smaller siphon to the inlet of an air-bubble pump in one tank, and returned to the other tank through the larger siphon. The interconnection assured that neither siphon could carry water if the other stopped flowing. This effectively prevented tank overflow.

A large scale siphon design for tidal water power to produce electricity is found in U.S. Pat. No. 4,288,985. A giant siphon would carry the rise and fall of ocean tides through a hydro turbine generator. However, one of its major design shortcomings is the omission of a way to prime the huge siphon or to maintain prime, essential for successful operation.

In all of the prior art methods of siphon-priming there are many needs for improvement:

(a) Priming by inversion is undesirable wherever spills could be damaging or dangerous;

(b) Lungpower siphon-filling, besides other limitations, is often unsanitary and hazardous;

(c) Self-priming siphons work only for low-elevations, with limited control;

(d) Induced-flow siphon-priming works well only in limited applications;

(e) Pumping or pouring to fill a siphon demands extra steps for too-small advantage;

(f) A conventional vacuum-pump is inefficient for siphon-priming. A vacuum pump good for efficient siphon startup-priming is overpowerful for maintaining prime in an operating siphon; and a vacuum pump that can maintain prime efficiently is underpowered for startup. Either way, when the siphon is filled, a need to prevent liquid entry to the pump is an unwelcome complexity;

(g) Siphon-priming by utilizing subatmospheric inlet pressure ("suction-lift") of liquid handling pumps is theoretically possible, but no practical prior examples have been found;

(h) Venturi-effect siphon-priming uses a small fraction of pump-outflow power to produce only enough vacuum to fill low elevation siphons;

(i) High-elevation, high-volume and long-extension siphons have seldom been attempted, largely due to the limitations of available priming methods;

(j) After a siphon is primed by any method that does not continue during operation, gases in the siphon accumulate at the top. When the liquid level drops to a predetermined level the flow stops, re-priming is necessary before flow can resume; and (k) For lack of reliable and efficient siphon-priming, few if any pipelines use siphons. Most pipeline flow is forced through by pumps consuming energy from non-renewable resources.

In all of the prior art found, there is a clear and consistent need for a more simple, reliable, controllable and versatile siphon-priming method.

SUMMARY OF THE INVENTION

Accordingly, besides the objects and advantages of providing a reliable hydraulic vacuum pump (HVP) that extracts gases mixed with liquids in subatmospheric pressure, several objects and advantages of the present invention are:

(a) To provide a simple and effective hydraulic vacuum pump (HVP) that requires no valves and only one mechanical moving part, the pump impeller;

(b) To provide a new and improved way of starting siphon flow by simply starting the hydraulic vacuum pump (HVP), which causes siphons to prime and remain primed to transport water by the power of gravity continuously with no further operator action;

(c) To provide a HVP that can serve to prime and maintain prime equally well in siphons that transport or recirculate liquid;

(d) To provide a HVP which, when used to maintain prime in elevated-siphon segments of a high-volume, long-distance fluid transport pipeline, would enable pipeline fluid flow by gravity power in place of pumps that consume energy from non-renewable resources. Power consumed for startup vacuum-priming and HVP priming maintenance to enable gravity-powered siphon flow, would be a small fraction of power consumed by pump-powered flow. Also, minor leaks in the miles of elevated-siphon-sections of a pipeline would not lose contents or contaminate environment; but air would leak in and signal the problem, and contents would not leak out;

(e) To provide a HVP that can prime as many kinds of siphons as possible, including single or multiple legs, high or low volume, long or short extension, high or low elevation, and single or multiple elevations of single or multiple interconnected siphons;

(f) To provide a HVP that will work with any kind of pump that has subatmospheric inlet pressure and will not trap gases or be damaged by mixtures of liquids and gases;

(g) To provide a new kind of vacuum pump that will continuously and reliably extract gases mixed with or entrained in liquids, from siphons or other space to be vacuumed;

(h) To provide a HVP that is adaptable to work with many different combinations of liquids and gases;

(i) To provide a HVP in which the speed and siphon-elevation limits of priming action may be primarily controlled by adjusting the pump-priming inlet orifice size; and (j) To provide a HVP that assures such reliable and convenient siphon operation that siphons with gravity-powered flow can replace energy-consuming pump-powered flow in many new uses that will each result in savings of non-renewable energy resources.

To achieve the foregoing objects and advantages, the hydraulic vacuum pump (HVP) includes a pump that has an unobstructed outlet and at least two inlet openings, one for pump priming and the other connected to a priming-siphon from which air is extracted, mixed with liquid in the pump in a novel automatic, pressure-activated cyclic action, and freely expelled in the outflow. The top or crown of the priming siphon has a vacuum inlet interconnected airtight to the outlet of a space to be vacuumed, such as the crown of another siphon.

Still further objects and advantages of the present invention include the economy and ease of production of a hydraulic vacuum pump (HVP) that can be assembled using centrifugal or other pumps and additional components that are already available.

Other objects, features and advantages of the present invention will become apparent from the subsequent description and appended claims, taken in conjunction with the accompanying drawings.

BRIEF DESCRIPTION OF THE DRAWINGS

FIG. 1 shows a simulated pipeline-siphon primed by a hydraulic vacuum pump (HVP).

FIG. 2 shows a test apparatus set up to exhaust air from a vertical tube or a simulated siphon of fixed height (144").

FIG. 3 is a graph of siphon elevations vs pump-priming inlet orifice sizes, for FIG. 2 pump tests.

Figure 4:
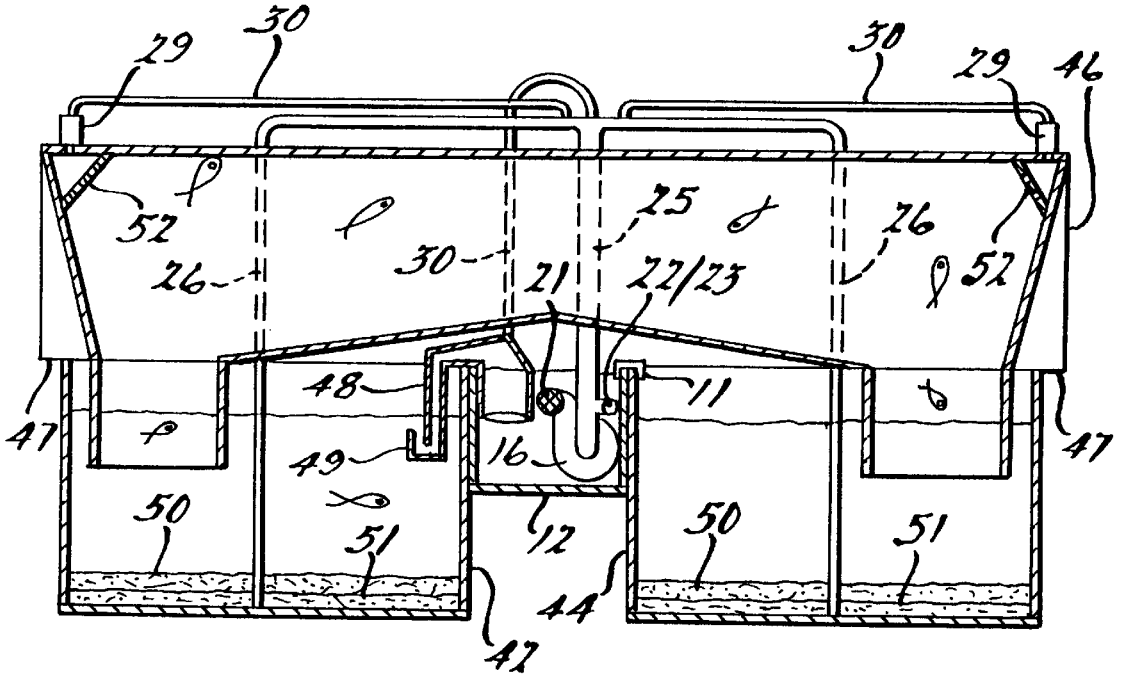
FIG. 4 shows a front view of a dual aquarium with a fish-bridge siphon and return-siphon, HVP equipped.

BEST MODE OF CARRYING OUT THE INVENTION AND DESCRIPTION OF THE PREFERRED EMBODIMENT(S)

Examples of the invention in FIGS. 1 through 5 have been tested and proved to operate as described with small-scale working-models, using transparent materials for observation as much as possible. Air and water exemplifies the behavior of most other liquids and gases. Numerous additional ways of using the same essential kinds of equipment and operating principles may be designed and built as their advantages are recognized.

FIG. 1 shows a large-siphon 27, with full elevation 36, that can effectively transport water 14, from simulated upper level reservoir 13, gravity powered by siphon drop distance 40, down to simulated lower level reservoir 15. The siphon 27 is kept primed full of water by continuously removing air from its crown 29 through tubing 30 connected to a hydraulic vacuum pump (HVP) 10 at vacuum connection 31.

Tubing 30 has an inside diameter just large enough to allow free air flow for vacuum air extraction. After priming is complete, minimal water flow through the same tubing path will be enough to continue extraction of random air reentry.

FIG. 1 also shows the HVP 10, within a container tank 12 filled with water 14. The HVP 10 includes a submerged pump 16, pump inlet 18, pump outlet 20, pump-priming inlet branch 22, and priming-siphon 25, 26, with vacuum connection 31. If electrical parts of pump 16 are submerged, they must be properly insulated and supplied with GFCI electrical power. Air enters connection 31, through tubing 30, from the outlet connection 29, of large-siphon 27 (in FIG. 1).

Pump inlets and outlet may be screened to keep foreign matter out. The pump 16 must be positioned so that, first, its outlet 20 must provide unobstructed outflow of both water and air from the pump. The expander/diverter 21 is a larger-size pipe with a 90 degree horizontal elbow attached to the existing pump outlet for free outflow with acceptable turbulence. Second, its pump-priming inlet branch 22 is open to a set orifice size with free inflow, and, third, its priming-siphon inlet branch 24 is connected to the downcomer leg 25 of the priming-siphon. The lower end of the priming-siphon riser leg 26, must be submerged. The elevation 36 of priming-siphon 25, 26 must always be no less than the elevation 36 of any siphon that it is to prime (such as large-siphon 27 in FIG. 1), or the equivalent final vacuum in any other enclosed space to be evacuated.

The HVP operates as follows: when the pump 16 starts there is a pressure drop or lower pressure at pump inlet 18 because of water outflow from pump outlet 20. Second, the lowered pressure lets in air from priming-siphon downcomer leg 25, which reduces water flow in from orifice 23 of pump-priming inlet 22. The air outflow lowers pressure inside the entire priming-siphon 25, 26 which causes water elevation in submerged priming-siphon riser leg 26. Third, the impeller of pump 16 briefly spins faster in an air/water mix, which allows pressure in pump inlet 18 to momentarily rise enough to stop bringing air in from the priming-siphon 25/26 and allow more water in from the pump-priming inlet 22. Fourth, inlet water re-engaging the impeller pushes an air/water mix through the pump outlet 18, which causes the cyclic action to restart at both pump inlet branches 22 and 24.

The cycle repeats at a rate determined mostly by the size of the pump-priming orifice 23, since other factors like priming-siphon and pump characteristics remain constant. Usually cycles occur slowly enough to see water movement, hear pump-speed changes, and see air bubbles in the outflow. Each time the air/water mix from siphons is expelled from pump outlet 20, the water level rises and pressure drops incrementally in both priming-siphon 25/26 and large-siphon 27, as air is extracted equally from both due to the vacuum air tubing 30 interconnection. As incremental pressure-lowering and elevation-raising cycles accumulate, cyclic action also slows down by increments. When there is no more air in either siphon, cyclic action stops. Pump outflow no longer includes air bubbles (if all siphon connections above water level are really leakproof). Water flowing into the pump then comes mostly from the priming-siphon, along with little water inflow from the pump-priming inlet and from vacuum air tubing 30 interconnection. Water flow in siphon 27 is according to gravity-power from drop-distance 40.

In FIG. 2 the size of interchangeable pump-priming orifice 23 is reduced step-by-step in test runs for each of five different pumps, while siphons and other test conditions remain unchanged.

As cyclic air extraction proceeds, water level fluctuations in riser leg 27 approximate the water level in vertical tube 28, where floating indicator 33 accurately indicates siphon elevation vacuum available from the HVP. Each slightly higher step of elevation causes slightly less air to be expelled in the next cycle. More energy is expended in work that extracts air from lower pressure. Cyclic air extraction continues, increasingly slower, until no more air bubbles appear in the water flowing from pump outlet 20, when low pressure above float 33 equals low pressure at pump inlet 18. Then the test elevation is the final position of indicator float 33 in tall (12 feet) and transparent vertical tube 28.

Larger orifices 23 exhaust more air in each quicker cycle, but stop removing air at a lower siphon-elevation. Smaller orifice sizes exhaust less air in each slower cycle, but reach lower final pressure with higher siphon-elevation.

In FIG. 3 test runs with each of five different pumps are graphed for each orifice-size vs resulting maximum elevation. Pump performance patterns were confirmed to be as shown, by repeated test runs. Each new test setup spent more attention to assure that no unaccounted variables affected results. The patterns did not change significantly. Their typical gradual rise to a curve of diminishing gain is explainable. As orifice size diminishes, eventually the pump cannot get enough water-flow to cause lower inlet pressure. The smallest orifice recommended for a given pump is the smallest one that shows undiminished rate of elevation gain on the curve.

Differences in pump-performance response to changing loads (as indicated by their performance curves on the graph) are attributed to pump-power and individual pump design and construction variations, such as the shape of the impeller and its volute space, and electromagnetic characteristics of the motor.

Figure 5:
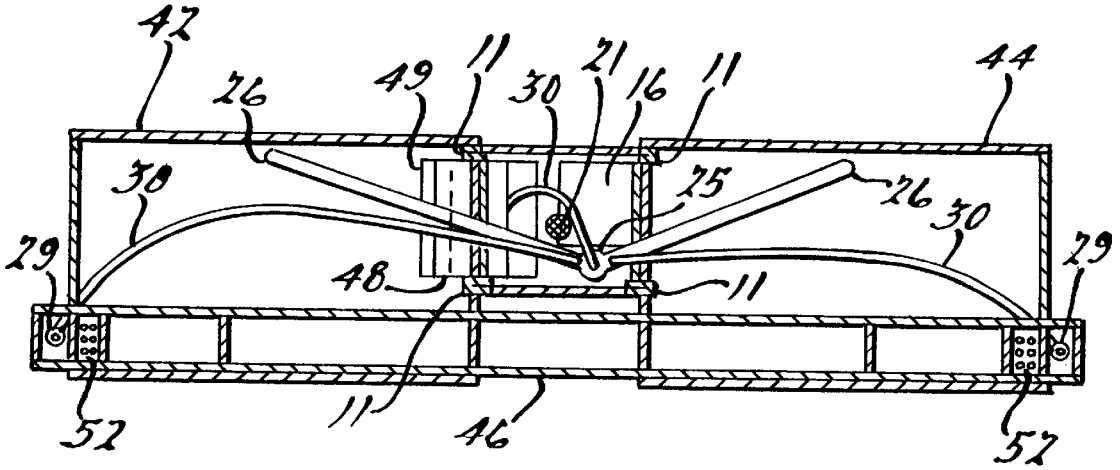
FIG. 5 shows a top view of a dual aquarium with a fish-bridge and return-siphon, HVP equipped.

In FIGS. 4 and 5 show two aquariums with a fish-bridge siphon 46, and a return-siphon 48, primed by HVP in its container 12. The priming siphon has a downcomer leg 26, and two equal-size riser legs 27, each with its lower end connected to an undergravel filter in a different tank. The riser legs 27 and downcomer leg 26 are joined at the crown to form priming-siphon 25/26.

The inside diameter (ID) of the downcomer leg 26 should approximately equal the pump inlet ID and the combined IDs of the two riser legs 27. Vacuum air tubing 30 interconnects the crown of return-siphon 48 and opposite end-crowns of the flat-topped fish-bridge siphon 46, to the crown of priming-siphon 25/26. Air outlet screens 52 are there to protect fish because, after initial priming, water flows through outlets 29, which assures extraction of any more air. The lowest siphon, return-siphon 48, primes first as siphon elevation rises during the cyclic action of HVP startup.

In full operation, water level in the HVP tank will be higher than aquarium tanks as shown, but the slightly lower level in tank 44 may he unnoticeable. Each riser 27 carries about half of the outflow water going through return-siphon 48 to tank 42. Water quantity that came from tank 44, cleaned and aerated, returns to tank 44 through the fish-bridge siphon 46, due to gravity. Water flow into tank 42 from return-siphon 48, uses an inverted-siphon restricted-outlet 49, to provide aerating surface agitation that is beneficial to aquatic animals. Additional surface agitation occurs in HVP-container 12 from the outflow of pump 16.

The models in FIGS. 1 through 5 demonstrate how the HVP works, and illustrate a few of its possible uses. They do not include specific examples of many additional usages. Many improved designs and constructions should appear wherever siphons are used and wherever else a truly hydraulic vacuum-pump can be advantageous.

The fish-bridge example in FIGS. 4 and 5 has many possible dimensions and possible shape variations. The fish bridge could vary from a few inches high to approximately 34 feet high.

It should be noted that many conventional centrifugal pumps have a guarded inlet larger than the outlet. HVP pumps need outlets completely unobstructed, which is the main reason for "expander/diverter" outlet fittings in FIGS. 2, 3 and 5. For the test setup in FIG. 2, all five pumps were adapted to ½ inch inlet, and outlet sizes either ⅜" expanded to ¾", or ½" expanded to 1". Conventional centrifugal pumps are also usually built to be operated with the inlet located below the pump body. An HVP pump must not trap air, so it is necessary to reposition such pumps for HVP use.

A HVP setup as in FIG. 1, with a priming siphon of six inches elevation and its vacuum inlet 31 closed, primed full in six seconds. The same HVP in a setup illustrated by FIG. 1 as shown with vacuum interconnection and the separate siphon having six inches elevation and three quarts of combined siphon volume, primed full in sixty seconds. And, an aquarium setup as shown in FIGS. 4 and 5, with a 34 inch elevation fish-bridge an HVP with a 35 inch elevation primary-siphon, plus its return-siphon, having a combined siphon volume of three gallons, took forty minutes to fully prime.

All three examples used the same centrifugal pump (# II in FIG. 3) and the same size (¼") pump-priming inlet orifice. Variables that affect HVP siphon-priming time include at least: total volume of all crown-interconnected siphons; highest siphon elevation to be reached; size of the pump-priming orifice; and effectiveness of the pump.

The maximum height (elevation) any siphon can reach is about 34 feet. The limits of HVP capabilities have yet to be established. A fractional (1/20) horsepower centrifugal pump has produced siphon elevations (vacuum levels) above twelve feet of water in the inventor's HVP tests. The HVP already produces greater vacuum with less energy expenditure than conventional means. The vacuum-producing and siphon-elevating limits of the HVP will be revealed when appropriate experiments are conducted with sufficiently powerful pumps and related equipment.

To prime really large siphons such as would be required in the mileage of a pipeline siphon-system, millions of cubic feet of air would have to he extracted; then prime would have to be maintained to keep siphon(s) full to their crown(s) for efficient fluid-transport by gravity-power. First, a more efficient vacuum machine would have to remove most of the air and fill the siphon(s) nearly to the top of their crown(s); then the HVP would serve to maintain prime at each crown(s), extracting gases combined with liquids. Vacuum-priming for startup, and HVP priming maintenance throughout operation of a siphon pipeline would of course consume some energy, but would enable pipeline flow powered by gravity, wherever terrain contours and skillful designs permit. The alternative of pipeline flow entirely powered by pumps, presently consumes incomparably greater quantities of non-renewable energy.

How vacuum-priming could be applied for pipeline-siphon startup is illustrated in an aquarium setup as in FIG. 5, as follows:

Siphons of 34" maximum elevation and 3 gallons total volume that had required 40 minutes to prime by HVP, were primed in only 2 minutes by using a household vacuum-cleaner machine to extract air (through a one-way valve), almost to the siphon crown-top level. Then, to avoid water entry in a machine not meant to handle liquids at all, and because it is no longer needed, the vacuum-cleaner machine was disconnected. The HVP was then left running to easily maintain prime as long as operation was desired. On a much larger scale, with industrial-strength vacuum pumps and an appropriately designed HVP, priming and operation of much larger siphons, and higher elevation (within physical limits) could be accomplished in a comparable manner.

What is claimed is:

1. A hydraulic vacuum pump system, said system including:

a pump having an inlet and an outlet both submerged in a liquid, said outlet having low resistance to fluid outflow, said inlet having connections that block inward gaseous leakage, said inlet having at least two branches, a first branch being closer to said pump inlet than a second branch;

said first inlet branch being submerged and constantly open to an unobstructed orifice, said orifice being smaller than said pump inlet;

said second inlet branch being connected to a downcomer leg of a priming siphon, said downcomer leg sized to approximately a same inside diameter (ID) as said pump inlet;

said priming siphon having at least one riser leg with a low end submerged in liquid;

said riser leg having an inside diameter about equal to the inside diameter of the pump inlet; and a crown of said priming siphon being equipped with a vacuum inlet.

2. The hydraulic vacuum pump of claim 1 wherein said crown of said priming-siphon is interconnected by leakproof channels to said crowns of other siphons that are positioned with lower ends immersed in liquid and have elevation no greater than said priming siphon, said channels extract increments of gases from said siphons until accumulated extraction increments completely prime all of said siphons.

3. The hydraulic vacuum pump of claim 2 wherein when said priming siphon is filled with liquid, flow in said priming-siphon is nearly pump-flow capacity minus two smaller inflows from said pump-priming orifice and said vacuum inlet.

4. The hydraulic vacuum pump of claim 3 wherein said liquid flow through said priming-siphon is recirculated for filtration through riser legs of said priming-siphon in separate liquid-containers, said separate containers have a same liquid startup level and use the hydraulic vacuum pump to prime a return siphon to complete said recirculation flow-path between said separate containers.

5. The hydraulic vacuum pump of claim 4 wherein said return-siphon has an inverted-siphon outlet, restricted for accelerated outflow, powered by gravity and siphon drop distance, to provide surface agitation.

6. The hydraulic vacuum pump of claim 1 wherein said vacuum connection at said crest of said priming-siphon may be used to extract air and maintain vacuum according to elevation in said priming-siphon from enclosed spaces other than siphons.

7. The hydraulic vacuum pump of claim 1 having water-elevation vacuum up to 12 feet using a 1/20th fractional horsepower pump, said pump having one moving part, said moving part is an impeller.

8. The hydraulic vacuum pump of claim 1 having water-elevation vacuum approaching 34 feet with an adequate pump.

9. The hydraulic vacuum pump of claim 1 wherein said pump is a centrifugal pump that is unharmed by a mixture of gas and liquid.

10. The hydraulic vacuum pump of claim 1 wherein a leak in said siphon would force air into said siphon and allow little or no leakage of liquid contents out of said siphon.

11. The hydraulic vacuum pump of claim 1 further including a pump that can handle liquids and gases simultaneously without extraordinary wear or damage.

12. The hydraulic vacuum pump of claim 1 wherein said orifice is large enough to assure minimum liquid flow through said pump, said orifice controls rate and limit of air extraction.

13. The hydraulic vacuum pump of claim 1 wherein said riser leg is submerged in same container as said pump inlet and outlet.

14. The hydraulic vacuum pump of claim 1 wherein said riser leg is submerged in a second container of approximately a same surface level as said container holding said pump.

15. The hydraulic vacuum pump of claim 1 wherein said vacuum inlet is closed and air extraction is needed only for said priming siphon.

16. The hydraulic vacuum pump of claim 1 wherein said vacuum inlet is connected to an enclosed space where air or gas is to be removed at subatmospheric pressure whether or not liquids are also present.

17. The hydraulic vacuum pump of claim 1 wherein said vacuum inlet is connected by leakproof channels to crowns of other siphons.

18. A method of using a hydraulic vacuum pump to extract air along with liquid from the priming-siphon in an automatic pressure-activated cyclic action, said action including:

unobstructed out flowing of liquid from said pump to cause lower pressure at the inlet of said pump;

air forced into said pump from a priming siphon inlet branch by atmospheric pressure;

said air mixing with liquid inflow from a pump-priming inlet orifice;

said air-liquid mixture within said pump causing pump impeller to spin faster momentarily;

said inlet pressure at pump inlet rising at a predetermined amount which stops air inflow at said priming siphon, drops a riser leg elevation and restores liquid inflow at said inlet orifice; and re-engaging liquid inflow at said impeller forces air-liquid mix through said pump outlet until outflow is all liquid.

19. The method of claim 18 wherein said gas extraction lowers inlet pressure and raises a siphon elevation incrementally.

20. The method of claim 19 wherein said increments of rising are predetermined by size of said pump-siphon orifice, and said air-liquid mix causing said pump inlet pressure to rise momentarily to allow liquid inflow from pump primary orifice to increase again at a start of a next cycle.

* * * * *